US012521605B2

(12) United States Patent
Tanaami et al.

(10) Patent No.: US 12,521,605 B2
(45) Date of Patent: Jan. 13, 2026

(54) SWING ANALYSIS SYSTEM AND SWING ANALYSIS METHOD

(71) Applicant: SINTOKOGIO, LTD., Nagoya (JP)

(72) Inventors: Yoshikane Tanaami, Nagoya (JP); Miyuki Hayashi, Nagoya (JP)

(73) Assignee: SINTOKOGIO, LTD., Aichi (JP)

( * ) Notice: Subject to any disclaimer, the term of this patent is extended or adjusted under 35 U.S.C. 154(b) by 263 days.

(21) Appl. No.: 18/319,856

(22) Filed: May 18, 2023

(65) Prior Publication Data

US 2024/0001194 A1 Jan. 4, 2024

(30) Foreign Application Priority Data

Jun. 30, 2022 (JP) ..... 2022-106273

(51) Int. Cl.

| | |
|---|---|
| ***A63B 24/00*** | (2006.01) |
| ***A63B 60/46*** | (2015.01) |
| ***A63B 69/36*** | (2006.01) |
| *A63B 71/06* | (2006.01) |

(52) U.S. Cl.

CPC ..... *A63B 24/0006* (2013.01); *A63B 60/46* (2015.10); *A63B 69/3608* (2013.01); *A63B 2024/0068* (2013.01); *A63B 2060/464* (2015.10); *A63B 71/0622* (2013.01); *A63B 2214/00* (2020.08); *A63B 2220/40* (2013.01); *A63B 2220/56* (2013.01); *A63B 2220/833* (2013.01); *A63B 2220/836* (2013.01)

(58) Field of Classification Search

CPC . A63B 24/0006; A63B 60/46; A63B 69/3608; A63B 71/0622; A63B 2024/0068; A63B 2060/464; A63B 2214/00; A63B 2220/40; A63B 2220/56; A63B 2220/833; A63B 2220/836; A63B 69/3667; A63B 71/06; A63B 71/0619; G09B 19/0038

USPC ..... 473/150, 217, 220, 221, 223, 266, 409

See application file for complete search history.

(56) References Cited

U.S. PATENT DOCUMENTS

| | | | | |
|---|---|---|---|---|
| 10,300,333 | B2 * | 5/2019 | Dau | A63B 69/3632 |
| 2005/0215340 | A1 | 9/2005 | Stites et al. | |
| 2010/0151957 | A1 * | 6/2010 | Hohla | A63B 24/0021 348/169 |
| 2011/0230274 | A1 * | 9/2011 | Lafortune | A63B 71/0669 473/217 |
| 2015/0251071 | A1 * | 9/2015 | Steusloff | A43B 3/34 702/141 |

(Continued)

FOREIGN PATENT DOCUMENTS

| | | |
|---|---|---|
| JP | H04-117972 A | 4/1992 |
| JP | H09-154996 A | 6/1997 |

(Continued)

OTHER PUBLICATIONS

Office Action dated Nov. 11, 2025 issued in Japanese patent application No. 2022-106273.

*Primary Examiner* — Nini F Legesse

(74) *Attorney, Agent, or Firm* — Harness, Dickey & Pierce, P.L.C.

(57) ABSTRACT

A swing analysis system includes: shoes containing respective pressure sensors; a club having a grip that contains a pressure sensor; and an information processing device configured to specify a problem in a swing movement, with reference to respective output signals from the pressure sensors and an output signal from the pressure sensor.

4 Claims, 2 Drawing Sheets

(56) References Cited

U.S. PATENT DOCUMENTS

| | | | | |
|---|---|---|---|---|
| 2015/0352404 | A1* | 12/2015 | Schwenger | A63B 69/0002 700/91 |
| 2016/0310820 | A1* | 10/2016 | Kline | G06F 3/014 |
| 2019/0314703 | A1* | 10/2019 | Onuki | A63B 69/3632 |
| 2020/0047026 | A1 | 2/2020 | Onuki | |

FOREIGN PATENT DOCUMENTS

| | | | |
|---|---|---|---|
| JP | 2004-024627 | A | 1/2004 |
| JP | 2014-147559 | A | 8/2014 |
| JP | 202025723 | A | 2/2020 |
| JP | 2020-130957 | A | 8/2020 |

* cited by examiner

SWING ANALYSIS SYSTEM AND SWING ANALYSIS METHOD

This Nonprovisional application claims priority under 35 U.S.C. § 119 on Patent Application No. 2022-106273 filed in Japan on Jun. 30, 2022, the entire contents of which are hereby incorporated by reference.

TECHNICAL FIELD

The present invention relates to a system and method for analyzing a swing movement that is performed by a user in golf.

BACKGROUND ART

Golf is a popular sport, and thus many people wish to improve their golf skills. Accordingly, in the market, there is a high demand for a tool that helps to improve golf skills. Examples of such a tool include golf shoes disclosed in Patent Literature 1. The golf shoes disclosed in Patent Literature 1 include a pair of left and right shoes and a sensor device attached to each of the left and right shoes. Use of such golf shoes disclosed in Patent Literature 1 makes it possible to measure an orientation of each of the left and right shoes and a positional relationship between the left and right shoes.

CITATION LIST

Patent Literature

[Patent Literature 1]
Japanese Patent Application Publication Tokukai No. 2020-25723

SUMMARY OF INVENTION

Technical Problem

For analysis of a problem in a swing movement, it is important to examine a palm movement (way of gripping a club) of a golfer in addition to a foot movement of the golfer. For example, in a case where a ball is sliced or hooked, the cause of such slicing or hooking is, in some cases, the foot movement and is, in other cases, the palm movement. Many golfers experience a phenomenon in which changing the way of gripping the club results in no slicing and no hooking. However, a technique disclosed in Patent Literature 1 cannot ascertain the palm movement and thus cannot specify the problem in the palm movement. At least in this regard, the technique disclosed in Patent Literature 1 has room for improvement.

An aspect of the present invention is achieved in light of the foregoing problem. It is an object of the aspect of the present invention to provide a swing analysis system and a swing analysis method which make it possible to more appropriately analyze a problem in a swing movement.

Solution to Problem

A swing analysis system in accordance with an aspect of the present invention includes shoes, a club, and an information processing device. The shoes contain respective first pressure sensors. The club has a grip that contains a second pressure sensor. The information processing device is a device configured to specify a problem in a swing movement that a user wearing these shoes has performed with use of the club. The problem is specified with reference to output signals from the first pressure sensors and an output signal from the second pressure sensor.

In addition, a swing analysis method in accordance with an aspect of the present invention is a swing analysis method that uses shoes (containing respective first pressure sensors) and a club (having a grip that contains a second pressure sensor). This swing analysis method includes a specifying process in which an information processing device specifies a problem in a swing movement that a user wearing these shoes has performed with use of the club. The problem is specified with reference to output signals from the first pressure sensors and an output signal from the second pressure sensor.

Advantageous Effects of Invention

According to an aspect of the present invention, it is possible to specify a problem in a swing movement on the basis of a palm movement in addition to a foot movement. Thus, it is possible to more appropriately analyze the problem in the swing movement.

DESCRIPTION OF EMBODIMENTS

Figure 1:
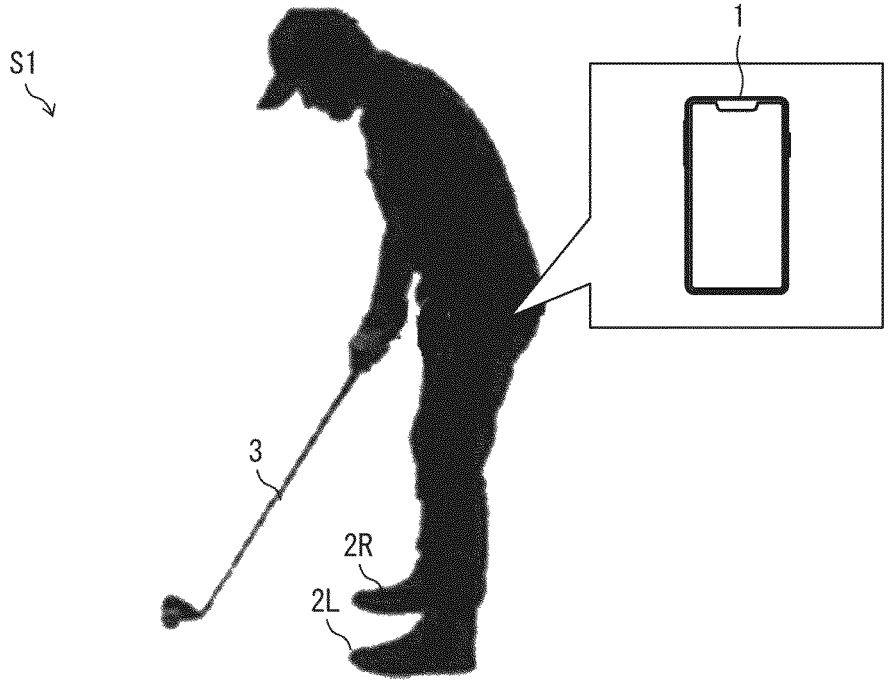
FIG. 1 is a view schematically illustrating a user who uses a swing analysis system in accordance with an embodiment of the present invention.

[Outline of Embodiments of the Present Disclosure]

First, the following will describe an outline of embodiments of the present disclosure.

(Item 1)

A swing analysis system including: shoes containing respective first pressure sensors; a club having a grip that contains a second pressure sensor; and an information processing device configured to specify, with reference to output signals from the first pressure sensors and an output signal from the second pressure sensor, a problem in a swing movement that a user wearing the shoes has performed with use of the club.

According to the above configuration, it is possible to specify a problem in a swing movement on the basis of a palm movement in addition to a foot movement. Thus, it is possible to more appropriately analyze the problem in the swing movement.

(Item 2)

The swing analysis system according to Item 1, wherein the information processing device is configured to: specify a problem in a foot movement of the user on the basis of time series of foot pressures during the swing movement, the foot pressures being indicated by the output signals from the first pressure sensors; and specify a problem in a palm movement of the user on the basis of a time series of a grip strength during the swing movement, the grip strength being indicated by the output signal from the second pressure sensor.

According to the above configuration, it is possible to specify each of a problem in a foot movement and a problem in a palm movement. This makes it possible for the user to work on improvement of the foot movement and improvement of the palm movement during the swing movement.

(Item 3)

The swing analysis system according to Item 1 or 2, wherein: the club further contains an acceleration sensor; and the information processing device is configured to further specify a problem in an arm movement of the user on the basis of time series of accelerations during the swing movement, the accelerations being indicated by an output signal from the acceleration sensor.

According to the above configuration, it is possible to further specify a problem in an arm movement. This makes it possible for the user to work on improvement of the problem in the arm movement during the swing movement.

(Item 4)

The swing analysis system according to any one of Items 1 to 3, wherein the information processing device is configured to: specify an angle of inclination of a ground on which the user stands, with reference to foot pressures before or after the swing movement, the foot pressures being indicated by the output signals from the first pressure sensors; and specify a problem in the swing movement with reference to the angle of inclination in addition to the output signals from the first pressure sensors and the output signal from the second pressure sensor.

According to the above configuration, it is possible to appropriately analyze a swing movement that has been performed by a user standing on an inclined ground (for example, bunker) as well as a swing movement that has been performed by a user standing on a horizontal ground.

(Item 5)

A swing analysis method using shoes containing respective first pressure sensors and a club having a grip that contains a second pressure sensor, the method including a specifying process in which an information processing device specifies, with reference to output signals from the respective first pressure sensors and an output signal from the second pressure sensor, a problem in a swing movement that a user wearing the shoes has performed with use of the club.

According to the above configuration, it is possible to specify a problem in a swing movement on the basis of a palm movement in addition to a foot movement. Thus, it is possible to more appropriately analyze the problem in the swing movement.

[Examples of Embodiments of the Present Disclosure]

The following will describe embodiments of the present disclosure in detail with reference to the drawings. Note that, components identical to each other will be assigned the same reference sign, and a duplicate description will be omitted.

(Configuration of Swing Analysis System)

Figure 2:
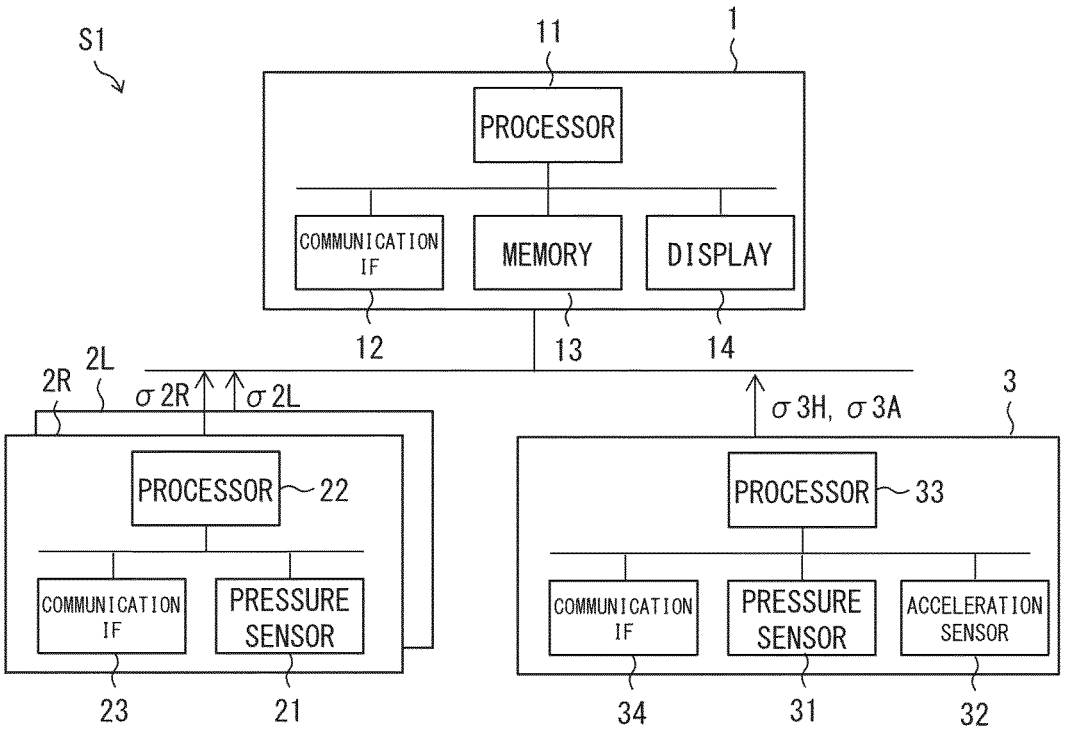
FIG. 2 is a block diagram showing a configuration of the swing analysis system illustrated in FIG. 1.

With reference to FIGS. 1 and 2, the following will describe a configuration of a swing analysis system S1. FIG. 1 is a view schematically illustrating a user U using the swing analysis system S1, and FIG. 2 is a block diagram showing a configuration of the swing analysis system S1.

The swing analysis system S1 is a system configured to analyze a swing movement performed by the user U during golfing and includes an information processing device 1, shoes 2R and 2L, and a club 3. The information processing device 1, the shoes 2R and 2L, and the club 3 are configured to be capable of communicating with each other via near field wireless communication. The user U puts on the shows 2R and 2L and performs a swing movement with use of the club 3.

The shoe 2R includes a pressure sensor 21, a processor 22, and a communication interface 23. The pressure sensor 21 is contained in a sole of the shoe 2R and detects a right foot pressure FR of the user U. Here, the right foot pressure FR is a pressure that is applied to the sole of the shoe 2R by a right foot of the user U while the user U is standing. The pressure sensor 21 outputs an output signal σ2R, which is in turn converted to a digital signal with use of an AD converter (not illustrated) and then is supplied to the processor 22. The processor 22 transmits, to the information processing device 1 via the communication interface 23, the output signal σ2R that is from the pressure sensor 21 and that is indicative of the right foot pressure FR of the user U. The shoe 2L is configured in the same manner as the shoe 2R, and transmits, to the information processing device 1 via the communication interface 23, an output signal σ2L that is from another pressure sensor 21 and that is indicative of a left foot pressure FL of the user U. Here, the left foot pressure FL is a pressure that is applied to the sole of the shoe 2L by a left foot of the user U while the user U is standing.

Examples of the processor 22 include a microcontroller and a programmable logic controller (PLC). Examples of the communication interface 23 include an infrared communication interface, a Bluetooth (registered trademark) communication interface, and a WiFi (registered trademark) communication interface.

The club 3 includes a pressure sensor 31, an acceleration sensor 32, a processor 33, and a communication interface 34. The pressure sensor 31 is contained in a grip of the club 3 and detects a grip strength FH of the user U. The acceleration sensor 32 is contained in a head or shaft of the club 3 and detects accelerations Ax, Ay, and Az of the club 3. An output signal σ3H from the pressure sensor 31 and an output signal σ3A from the acceleration sensor 32 are each converted to a digital signal with use of an AD converter (not illustrated) and then are supplied to the processor 33. The processor 33 transmits, to the information processing device 1 via the communication interface 34, the output signal σ3H that is from the pressure sensor 31 and that is indicative of the grip strength FH of the user U and the output signal σ3A that is from the acceleration sensor 32 and that is indicative of the accelerations Ax, Ay, and Az of the club 3. Note that the club 3 may be a club that can be used in real golf (that can hit a real golf ball) or may be a club that cannot be used in real golf (that cannot hit a real golf ball). Examples of the latter club include a swing training instrument which has a shaft that is shorter than a club usable in real golf and that is provided with a weight attached to a tip of the shaft.

Examples of the processor 33 include a microcontroller and a programmable logic controller (PLC). Examples of the communication interface 34 include an infrared communication interface, a Bluetooth (registered trademark) communication interface, and a WiFi (registered trademark) communication interface.

The information processing device 1 includes a processor 11, a communication interface 12, a memory 13, and a display 14. The processor 11 executes a swing analysis program stored in the memory 13, so that the information processing device 1 specifies a problem in a swing movement with reference to: the output signals σ2R and σ2L from the pressure sensors 21; the output signal σ3H from the pressure sensor 31; and the output signal σ3A from the acceleration sensor 32. In this case, the communication interface 12 is used to receive: the output signals σ2R and σ2L outputted from the pressure sensors 21 and transmitted respectively from the shoes 2R and 2L; and the output signals σ3H and σ3A outputted respectively from the pressure sensor 31 and the acceleration sensor 32 and transmitted from the club 3. Further, the display 14 is used to display a screen indicating a result of an analysis of the swing movement.

Examples of the processor 11 include a central processing unit (CPU). Examples of the communication interface 12 include an infrared communication interface, a Bluetooth (registered trademark) communication interface and a WiFi (registered trademark) communication interface. Examples of the memory 13 include a semiconductor random access memory (RAM). Examples of the display 14 include a liquid crystal display (LCD).

In the present embodiment, the information processing device 1 is assumed to be a smartphone carried by the user U. However, the present invention is not limited to this. The information processing device 1 may be realized as: a general-purpose computer (personal computer) or general-purpose game machine (home game machine) installed at home or the like; a dedicated game machine (arcade game machine) installed in an amusement arcade or the like; or a dedicated simulator installed at a golf practice range or the like.

The swing analysis program may be stored in a computer-readable non-transitory tangible storage medium. Examples of such a storage medium include a tape, a disk, a card, a semiconductor memory, and a programmable logic circuit. The storage medium in which the swing analysis program is stored may or may not be contained in the information processing device 1. In addition, the storage medium may or may not be connected with the information processing device 1.

(Flow of Swing Analysis Method)

Figure 3:
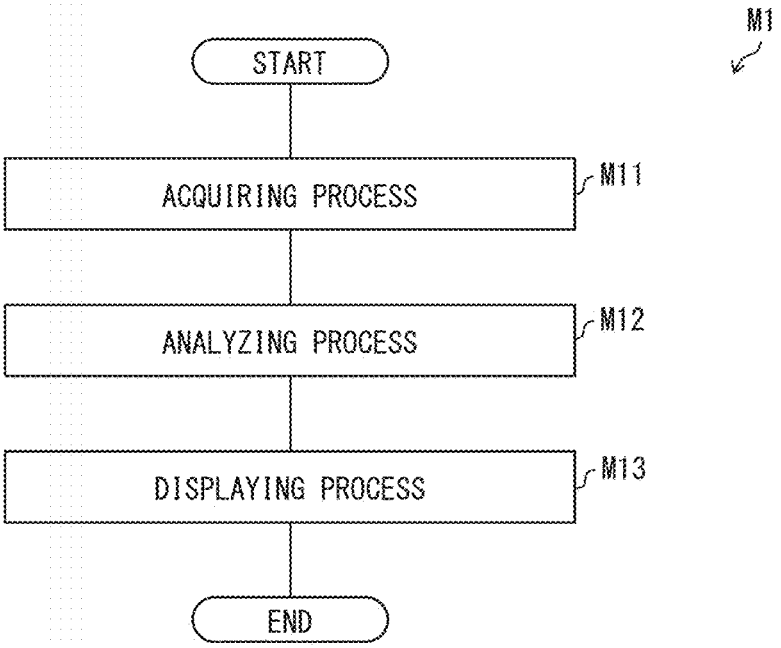
FIG. 3 is a flow chart showing a flow of a swing analysis method in accordance with an embodiment of the present invention.

With reference to FIG. 3, the following will describe a flow of a swing analysis method M1 using the swing analysis system S1. FIG. 3 is a flow chart showing a flow of the swing analysis method M1.

The swing analysis method M1 includes an acquiring process M11, an analyzing process M12, and a displaying process M13.

The acquiring process M11 is a process in which the information processing device 1 acquires, respectively from the shoes 2R and 2L, the output signals σ2R and σ2L from the pressure sensors 21 and also acquires, from the club 3, the output signal σ3H from the pressure sensor 31 and the output signal σ3A from the acceleration sensor 32. As described above, the output signal σ2R from the pressure sensor 21 of the shoe 2R indicates the right foot pressure FR of the user U. The output signal σ2L from the pressure sensor 21 of the shoe 2L indicates the left foot pressure FL of the user U. The output signal σ3H from the pressure sensor 31 of the club 3 indicates the grip strength FH of the user U. The output signal σ3A from the acceleration sensor 32 of the club 3 indicates the accelerations Ax, Ay, and Az of the club 3.

The analyzing process M12 is a process in which the information processing device 1 specifies a problem in a swing movement that the user U wearing the shoes 2R and 2L has performed with use of the club 3. The problem is specified with reference to: the output signals σ2R and σ2L respectively from the pressure sensors 21 of the shoes 2R and 2L; the output signal σ3H from the pressure sensor 31 of the club 3; and the output signal σ3A from the acceleration sensor 32 of the club 3, the output signals σ2R, σ2L, σ3H, and σ3A having been acquired in the acquiring process M11.

The processor 11 of the information processing device 1 specifies a problem in a foot movement of the user U on the basis of time series of the right foot pressure FR and the left foot pressure FL during the swing movement. In one example, a slice pattern and a hook pattern are prepared (that is, created and stored) in advance. The slice pattern corresponds to patterns of time series of the right foot pressure and the left foot pressure in a case where a ball is sliced, whereas the hook pattern corresponds to patterns of time series of the right foot pressure and the left foot pressure in a case where a ball is hooked. In the analyzing process M12, the time series of the right foot pressure FR and the left foot pressure FL during the swing movement are compared with the slice pattern and the hook pattern. In a case where the time series of the right foot pressure FR and the left foot pressure FL during the swing movement correspond to the slice pattern, a problem that causes slicing is specified to be present in the foot movement of the user U. In a case where the time series of the right foot pressure FR and the left foot pressure FL during the swing movement correspond to the hook pattern, a problem that causes hooking is specified to be present in the foot movement of the user U.

The problem in the foot movement may be specified on the basis of the time series themselves of the right foot pressure FR and the left foot pressure FL as described above or may be specified on the basis of a feature amount that is calculated from the time series of the right foot pressure FR and the left foot pressure FL. Examples of such a feature amount include a center-of-gravity balance, stability, weight shift, and foot orientation. Further, the problem in the foot movement may be specified, with reference to the time series of the right foot pressure FR and the left foot pressure FL, with use of a trained model that has been generated through machine learning. The same is true in specifying the problem in the foot movement with reference to the feature amount.

In addition, the processor 11 of the information processing device 1 specifies a problem in a palm movement (way of gripping the club 3) of the user U on the basis of a time series of the grip strength FH during the swing movement. In one example, a slice pattern and a hook pattern are prepared (that is, created and stored) in advance. The slice pattern corresponds to a pattern of a time series of the grip strength in a case where a ball is sliced, whereas the hook pattern corresponds to a pattern of a time series of the grip strength in a case where a ball is hooked. In the analyzing process M12, the time series of the grip strength FH during the swing movement is compared with the slice pattern and the hook pattern. In a case where the time series of the grip strength FH during the swing movement corresponds to the slice pattern, a problem that causes slicing is specified to be present in the palm movement of the user U. In a case where the time series of the grip strength FH during the swing movement corresponds to the hook pattern, a problem that causes hooking is specified to be present in the palm movement of the user U.

The problem in the palm movement may be specified on the basis of the time series itself of the grip strength FH as described above or may be specified on the basis of a feature amount that is calculated from the time series of the grip strength FH. Examples of such a feature amount include a gripping power, stability, an orientation of the head of the club, and a frictional force. Further, the problem in the palm movement may be specified, with reference to the time series of the grip strength FH, with use of a trained model that has been generated through machine learning. The same is true in specifying the problem in the palm movement with reference to the feature amount.

Furthermore, the processor 11 of the information processing device 1 specifies a problem in an arm movement (way of swinging the club 3) of the user U on the basis of time series of the accelerations Ax, Ay, and Az during the swing movement. In one example, a slice pattern and a hook pattern are prepared (that is, created and stored) in advance. The slice pattern corresponds to patterns of time series of the accelerations in a case where a ball is sliced, whereas the hook pattern corresponds to patterns of time series of the accelerations in a case where a ball is hooked. In the analyzing process M12, the time series of the accelerations Ax, Ay, and Az during the swing movement are compared with the slice pattern and the hook pattern. In a case where the time series of the accelerations Ax, Ay, and Az during the swing movement correspond to the slice pattern, a problem that causes slicing is specified to be present in the arm movement of the user U. In a case where the time series of the accelerations Ax, Ay, and Az during the swing movement correspond to the hook pattern, a problem that causes hooking is specified to be present in the arm movement of the user U.

The problem in the arm movement may be specified on the basis of the time series themselves of the accelerations Ax, Ay, and Az as described above or may be specified on the basis of a feature amount that is calculated from the time series of the accelerations Ax, Ay, and Az. Further, the problem in the arm movement may be specified, with reference to the time series of the accelerations Ax, Ay, and Az, with use of a trained model that has been generated through machine learning. The same is true in specifying the problem in the arm movement with reference to the feature amount.

In addition, the information processing device 1 may be configured to calculate an angle of inclination of a ground on which the user U stands on the basis of the right foot pressure FR and the left foot pressure FL before or after the swing movement. In this case, the problems in the feet, palm, and arm movements may be specified as described above with reference to the angle of inclination calculated. For example, a slice pattern as describe above and a hook pattern as described above are prepared in advance for every angle of inclination. With use of the slice pattern and the hook pattern which correspond to the angle of inclination calculated, the problems in the foot, palm, and arm movements are specified as described above. This makes it possible to improve accuracy in specifying the problem.

The displaying process M13 is a process in which the information processing device 1 displays a screen for showing, to the user U, the problem that has been specified in the analyzing process M12 and/or a solution to the problem. In the displaying process M13, the processor 11 of the information processing device 1 causes the display 14 to display a screen for showing, to the user U, the problem that has been specified in the analyzing process M12 and/or a solution to the problem. In a case where the screen is displayed for showing, to the user, the solution to the problem, solutions to respective problems which may be specified in the analyzing process M12 are prepared in advance. Then, in the displaying process M13, among the solutions prepared in advance, a solution corresponding to the problem that has been specified in the analyzing process M12 is shown to the user U.

(Supplementary Note)

The present invention is not limited to the embodiments, but can be altered by a skilled person in the art within the scope of the claims. The present invention also encompasses, in its technical scope, any embodiment derived by combining technical means disclosed in differing embodiments as appropriate.

The invention claimed is:

1. A swing analysis system comprising:

shoes containing respective first pressure sensors;

a club having a grip that contains a second pressure sensor; and an information processing device configured to specify, with reference to output signals from the first pressure sensors and an output signal from the second pressure sensor, a problem that causes a ball to slice or hook in a swing movement that a user wearing the shoes has performed with use of the club, wherein the information processing device is configured to: compare time series of foot pressures during the swing movement, the foot pressures being indicated by the output signals from the first pressure sensors, with patterns of time-series prepared in advance; and specify that a problem that causes the ball to slice or hook is present in a foot movement of the user when the time series of the foot pressure during the swing movement correspond to the patterns of time-series prepared in advance, wherein the information processing device is configured to: compare a time series of a grip strength during the swing movement, the grip strength being indicated by the output signal from the second pressure sensor, with patterns of time-series prepared in advance; and specify that a problem that causes the ball to slice or book is present in a palm movement of the user when the time series of the grip strength during the swing movement correspond to the patterns of time-series prepared in advance.

2. The swing analysis system according to wherein:

the club further contains an acceleration sensor; and the information processing device is configured to: compare time series of accelerations during the swing movement, the accelerations being indicated by an output signal from the acceleration sensor, with patterns of time-series prepared in advance; and specify that a problem that causes the ball to slice or hook is present in an arm movement of the user when the time series of the accelerations during the swing movement corresponding to the patterns of time-series prepared in advance.

3. The swing analysis system according to claim 1, wherein the information processing device is configured to: specify an angle of inclination of a ground on which the user stands, with reference to foot pressures before or after the swing movement, the foot pressures being indicated by the output signals from the first pressure sensors; and specify a problem that causes the ball to slice or hook in the swing movement with reference to the angle of inclination in addition to the output signals from the first pressure sensors and the output signal from the second pressure sensor.

4. A swing analysis method comprising:

an acquiring process of acquiring output signals from respective first pressure sensors contained in shoes and an output signal from a second pressure sensor contained in a grip of a club; and a specifying process in which an information processing device specifies, with reference to the output signals from the first pressure sensors and the output signal from the second pressure sensor, a problem that causes the ball to slice or hook in a swing movement that a user wearing the shoes has performed with use of the club, wherein the information processing device is configured to: compare time series of foot pressures during the swing movement, the foot pressures being indicated by the output signals from the first pressure sensors, with patterns of time-series prepared in advance; and specify that a problem that causes the ball to slice or hook is present in a foot movement of the user when the time series of the foot pressures during the swing movement correspond to the patterns of time-series prepared in advance, wherein the information processing device is configured to: compare a time series of a grip strength during the swing movement, the grip strength being indicated by the output signal from the second pressure sensor, with patterns of time-series prepared in advance; and specify that a problem that causes the ball to slice or hook is present in a palm movement of the user when the time series of the grip strength during the swing movement correspond to the patterns of time-series prepared in advance.

* * * * *